US005380637A

United States Patent [19]

Yamashita et al.

[11] Patent Number: 5,380,637

[45] Date of Patent: Jan. 10, 1995

[54] SILVER HALIDE PHOTOGRAPHIC MATERIAL

[75] Inventors: Seiji Yamashita; Jun Kawagoe; Ichizo Toya, all of Kanagawa, Japan

[73] Assignee: Fuji Photo Film Co., Ltd., Kanagawa, Japan

[21] Appl. No.: 138,052

[22] Filed: Oct. 19, 1993

[30] Foreign Application Priority Data

Oct. 20, 1992 [JP] Japan ..... 4-281870
Oct. 28, 1992 [JP] Japan ..... 4-290458

[51] Int. Cl.[6] ..... G03C 1/76

[52] U.S. Cl. ..... 430/537; 430/531; 430/539; 430/961; 430/950; 430/403; 430/434; 430/627

[58] Field of Search ..... 430/539, 523, 536, 537, 430/961, 950, 403, 434, 602, 627

[56] References Cited

U.S. PATENT DOCUMENTS

| | | | |
|---|---|---|---|
| 4,396,706 | 8/1983 | Ishii et al. | 430/536 |
| 4,675,278 | 6/1987 | Sugimoto et al. | 430/523 |
| 4,859,576 | 8/1989 | Miyasaka et al. | 430/523 |
| 4,895,791 | 1/1990 | Mukunoki | 430/539 |
| 4,920,004 | 4/1990 | Bagchi | 430/523 |
| 5,250,409 | 10/1993 | Yasunami et al. | 430/523 |

*Primary Examiner*—Thomas R. Neville
*Attorney, Agent, or Firm*—Sughrue, Mion, Zinn, Macpeak & Seas

[57] ABSTRACT

A silver halide photographic material is disclosed in which a matting agent contained in a coating solution is prevented from settling in solution and peeling off during processing. The silver halide photographic material contains at least one light-sensitive emulsion and at least one surface protective layer on a support. The surface protective layer contains a polymer latex having an average particle size of up to 2 μm and a perticular precipitation amount as measured in a test coating solution or a crosslinked polymer latex having a hydrophilic group.

16 Claims, 1 Drawing Sheet

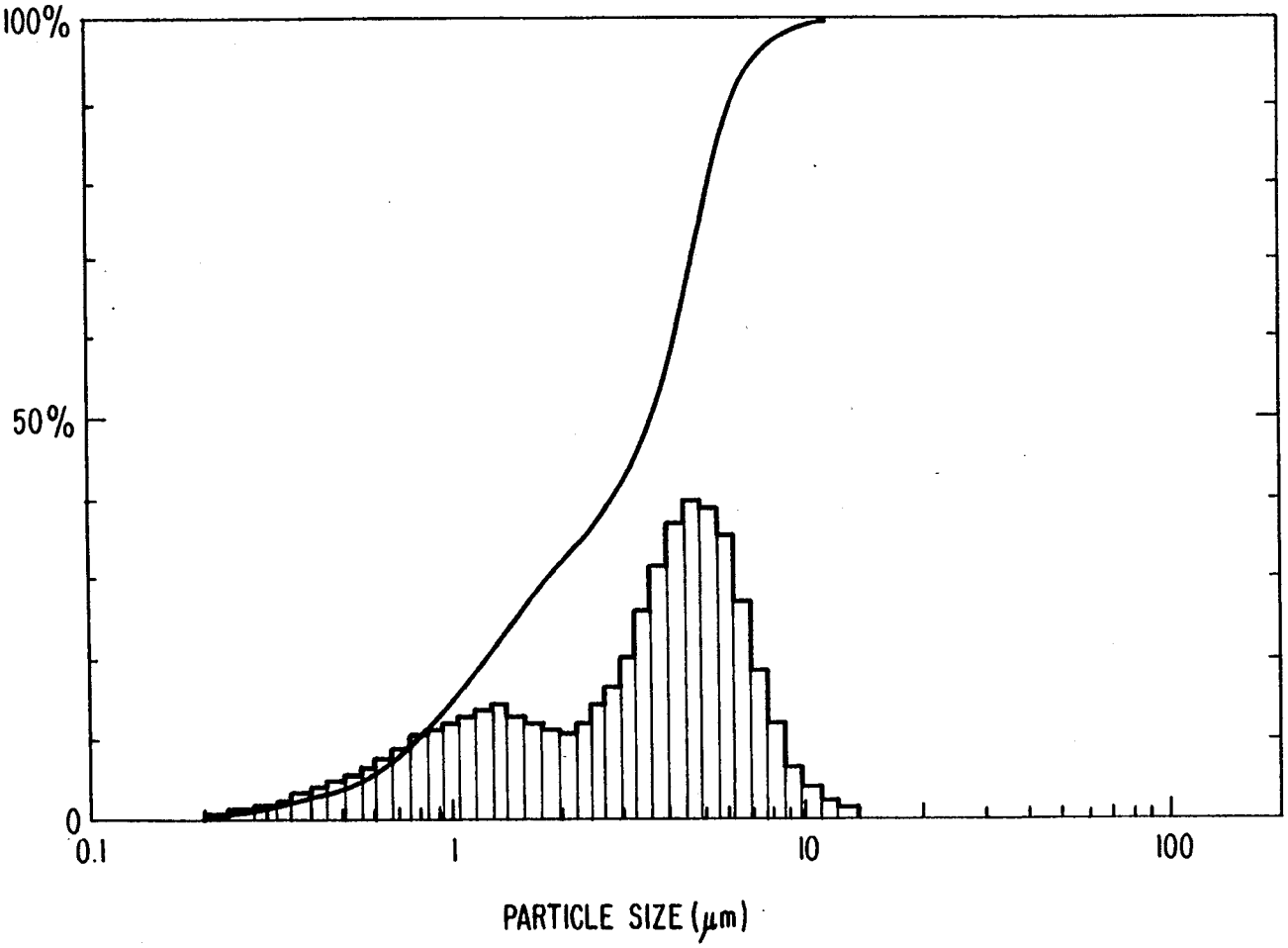
100%
50%
0
0.1
1
10
100
PARTICLE SIZE (μm)

SILVER HALIDE PHOTOGRAPHIC MATERIAL

FIELD OF THE INVENTION

The present invention relates to photographic material and, more particularly, photographic light sensitive material including a matting agent (a polymer latex) which when contained in a coating solution does not settle out of the same, and which does not peel off the photographic light sensitive material during processing.

BACKGROUND OF THE INVENTION

Recently, rapid processing at high temperatures during development processing of photographic material has become popular. Also, in automatic development processing of light-sensitive material, developing solutions are required which provide sufficient sensitivity in a short amount of time. Light-sensitive materials having excellent developing performance and which cause no residual color, even in a short amount of processing time, are also required as well as light-sensitive material which drys in a short amount of time after washing. Automatic processors may have a drying zone built the inside thereof and inferior drying performance of the light-sensitive material requires a larger drying zone which results in increased size of the automatic processor. Further, generation of large amounts of energy results in increasing the temperature in the room in which the automatic processor is located.

Accelerating the drying speed of the light-sensitive material as much as possible is desired. Generally, a hardener is added to the light sensitive material prior to costing thereof, and swelling rate in an emulsion layer and in a surface protective layer in the developing-fixing-rinsing processes is decreased to reduce the water content in the light-sensitive material before drying. Use of a significant amount of the hardener can accelerate drying speed. However, it increases developing time, lowers a sensitivity and reduces a covering power. In addition, using significant amounts of hardener causes delay of fixing speed of an unexposed silver halide grain, deterioration of residual color, and increase in residual hypo in the light-sensitive material after processing. Reduced water content in the light-sensitive material before the drying can be also achieved by decreasing the amounts of hydrophilic material (that is, gelatin), synthetic high molecular weight polymer, and hydrophilic low molecular weight polymer, contained in the light-sensitive material. In general, the hydrophilic low molecular weight polymer is used to prevent dry fog of a silver halide grain during a coating process and the removal thereof generates a fog on the light-sensitive material.

Light-sensitive material has been advantageously designed so that the amount of binder, particularly gelatin, coated on the light-sensitive material is reduced. However, decreasing the coated amount of gelatin in an emulsion layer generates increased pressure blackening, accurrence of black spots during processing, and layer peeling during processing due to reduced layer strength. This means a pickoff generally described in the art. Reducing the amount of the binder in a surface protective layer is may cause a matting agent contained in a surface protective layer coating solution to settle because of reduced protective colloid action by the gelatin. Also, in a coated layer, reducing binder levels causes the matting agent to be peeled off during processing which can stain a processing solution. Polyalkylene oxide, which is a nonionic series surface active agent, is conventionally added to a surface protective layer as an electrification controlling agent. However, the polyalkylene oxide affects a surface charge in the matting agent and accelerates settling of the matting agent from a coating solution containing the same.

As described in JP-A-51-6017 (the term "JP-A" as used herein means an unexamined published Japanese patent application), JP-A-61-20028, and JP-A-53-7231, the matting agent has an important function, in particular, preventing sticking, preventing static marks, and preventing scratchs caused when the surface protective layer of a photographic material contacts other substances. Conventionally, the matting agent has been incorporated into a non-light-sensitive protective layer (hereinafter referred to as a protective layer) for the above-mentioned purposes.

Concentrating of a solution containing polyalkylene oxide, in order to increase the protective colloid performance thereof in some cases accelerates settling from the solution due to the concentration of the polyalkylene oxide in the solution. Reduction of the coated amount of polyalkylene oxide causes static marks and inferior transportation of the light sensitive material during processing. Further, reducing the amount of water soluble polymer causes repelling of coating solution during coating and generation of coagulated material. Reducing the amount of water soluble polymer also lowers development swelling in case of the same drying speed and causes deterioration of covering power and sensitivity.

The present invention provides a photographic material without the above-discussed problems, and a method for producing the same.

As described in, for example, JP-A-1-154141, JP-A-1-159634, and JP-A-1-14574, a matting agent having a hydrophilic group is effective in terms of improving the stability of a matting agent in a coating solution and preventing the matting agent from peeling off from a coated material. However, an excess of hydrophilic groups causes elution of the matting agent from a light sensitive material containing the same during developing of the light sensitive material, which changes the size and amount of the matting agent in the light sensitive material before and after processing. Accordingly, glossiness of processed light sensitive material is reduced, and sliding performance and separating performance of the processed light-sensitive material are also reduced. Further, the processing solution used to process the light sensitive material is stained. In addition, holes remain in the light sensitive material where matting agent particles are removed. These holes resemble a white punched hole at a high density portion on a picture and cause deterioration of image quality.

Intensive investigations made by the present inventors resulted in obtaining a matting agent which does not dissolve in a processing solution due to a hydrophilic group present in the matting agent and due to a cross linking reaction with a cross linking agent. It was found by the present inventors that the use of a matting agent in accordance with the invention provides a light-sensitive material having excellent stability in a coating solution and having an excellent handling characteristics and image quality.

SUMMARY OF THE INVENTION

The first object of the present invention is to provide a photographic material which achieves high sensitization in a short processing time, while having a sufficiently rapid drying speed, and a method for producing the same. Another object is to provide a photographic material in which scattering of a coated amount of a matting agent is not caused by the settling of the matting agent in a coating solution, and a method for producing the same. Another object is to provide a photographic material which does not generate a stain in a processing solution due to the matting agent peeling and dissolving in the processing solution, and a method for producing the same.

Another object of the present invention is to provide a photographic material in which a static mark during handling is non generted, and at the same time the material has the above mentioned characteristics, the material also having excellent handling characteristics, in particular, separating performance and sliding performance, which do not change before and after processing, and a method for producing the same.

A still further object of the present invention is to provide a photographic material in which image quality, such as a glossiness and haze, does not fluctuate and deteriorate due to the manner of processing the material.

The above mentioned objects of the present invention and other objects have been achieved by a photographic material in accordance with the invention, which comprises a support provided thereon at least one light-sensitive emulsion and at least one surface protective layer comprising a hydrophilic colloid and a polymer latex having an average particle size of at least 2 μm. The polymer latex standing at 40° C. for 16 hours in a test coating solution, generates a precipitate in an amount of up to 30 weight %, based on the weight of the polymer latex added to the coating solution wherein the test coating solution includes:

| Ingredient | Amount |
|---|---|
| Gelatin (as a solid matter having a Ca content of at least 2000 ppm so as to provide the test coating solution with a viscosity of 0.2 to 0.3 poise at 40° C.) | 500 g |
| Polymer latex (as a solid matter dispersed in a 5 weight % gelatin solution so that the solid matter becomes 10 weight %) | 47 g |
| $H_2O$ | 400 ml |
| 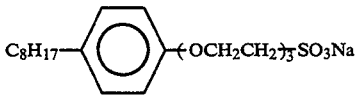 | 0.09 g |
| $C_{16}H_{33}O(CH_2CH_2O)_{10}H$ | 0.51 g |
| Poly(sodium acrylate) (average molecular weight: 400,000) | 1.0 g |

wherein the dispersion of the polymer latex is added to a solution prepared by swelling and dissolving gelatin in water at 40° C. and then the other compounds are added and mixed while stirring.

Furthermore, the above mentioned objects of the present invention and other objects have been achieved by a silver halide photographic material comprising a support provided thereon at least one light-sensitive emulsion layer and at least one surface protective layer containing a hydrophilic colloid and a crosslinked polymer latex having a hydrophilic group.

BRIEF DESCRIPTION OF THE DRAWING

The Figure illustrates a preferred particle size distribution in the matting agent in accordance with the invention.

DETAILED DESCRIPTION OF THE INVENTION

The polymer latex or crosslinked polymer latex having a hydrophilic group according to the present invention (sometimes hereinafter refered to as "matting agent according to the present invention") is incorporated in a surface protective layer. As long as the matting agent according to the present invention is incorporated in the surface protective layer, it may be incorporated or not incorporated in the other photographic constituting layers. The surface protective layer is a non-light-sensitive layer containing a hydrophilic colloid, is an uppermost layer on the support of a light-sensitive material and is provided on the outside of a light-sensitive layer from the support.

Any well-known hydrophilic colloid may be incorporated in the surface protective layer, but gelatin is particularly preferred.

The matting agent according to the present invention precipitates in an amount only by up to 30 weight %, preferably up to 20 weight % based on the weight of amount added to the above mentioned test coating solution, when the test coating solution is left standing at 40° C. for 16 hours.

The same gelatin as used for a binder of a light-sensitive material may be used for gelatin for the test coating solution.

The components are added in the above mentioned order at 40° C. while stirring at a low speed so that too many foams do not generate and the matting agent does not participate to thereby prepare a coating solution in which all the additives are mixed homogeneously.

The matting agent which is preferably used in the present invention includes the following polymer latexes designated "polymer latex-1" and "polymer latex-2", as will be described below, but suitable polymer latexes will be apparent to one skilled in the art.

The polymer latex-1 is a polymer latex having a hydrophilic group.

Examples of the hydrophilic group which the polymer latex-1 has include a carboxyl group, a phosphoric acid group, a sulfonic acid group, or a sulfuric acid group. The hydrophilic group preferably is a the carboxyl group.

Preferred monomers having a carboxyl group as the hydrophilic group include: acrylic acid, methacrylic acid, itaconic acid, maleic acid, fumaric acid, monoalkyl itaconate, monalkyl maleate, citraconic acid, and styrenecarboxylic acid. Phosphoric acid ester of hydroxyethyl acrylate is suitable for use as a monomer having a phosphoric acid group.

Examples of monomers having a sulfonic acid group include: styrenesulfonic acid, methacyloyloxypropyisulfonic acid, and 2-acrylamide-2-methylpropanesulfonic acid. Sulfuric acid ester of hydroxyethyl acrylate is suitable as the monomer having a sulfuric acid group.

Monomers having at least one ethylenically saturated double bond are suitable for use as a monomer for forming a copolymer in combination with the above mentioned monomers. Such monomers may be used in combination.

Suitable acrylic acid esters include methyl acrylate, ethyl acrylate, n-propyl acrylate, iso-propyl acrytate, n-butyl acrylate, iso-butyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxy-benzyl acrylate, 2-chlorocyclohexyl acrylate, cyclohexyl acrylate, furfuryl acrylate, tetrahydrofurfuryl acrylate, phenyl acrylate, 2-hydroxyethyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (an addition mole number n=9), 1-bromo-2-methoxyethyl acrylate, and 1,1-dichloro-2-ethoxyethyl acrylate.

Suitable methacrylic acid esters include methyl methacrylate, ethyl methacrylate, n-propyl methacrylate, isopropyl methacrylate, n-butyl methacrylate, iso-butyl methacrylate, sec-butyl meth-acrylate, tert-butyl meth-acrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3phenylpropyloxy)ethyl methacrylate, dimethylaminophenoxyethyl methacrylate, furfuryl methacrylate, tetrahydrofurfuryl methacrylate, phenyl meth-acrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition mole number n=6), allyl methacrylate, and methacrylic acid dimethylaminoethylmethyl chloride salt.

Suitable vinyl esters include vinyl acetate, vinyl propionate, vinyl butylate, vinyl isobutylate, vinyl caproate, vinyl chloroacetate, vinyl methoxyacetate, vinyl phenylacetate, vinyl benzoate, and vinyl salicylate.

Suitable olefins include dicyclopentadiene, ethylene, propylene, 1-butene, 1-pentene, vinyl chloride, vinylidene chloride, isoprene, chloroprene, butadiene, and 2,3-dimethylbutadiene.

Suitable styrenes include styrene, methylstyrene, dimethylstyrene, trimethylstyrene, ethytstyrene, isopropylstyrene, chloromethylstyrene, methoxystyrene, isoetoxystyrene, chlorostyrene, dichlorostyrene, didibromostyrene, trifluoromethylstyrene, and methyl vinylbenzoate.

Suitable crotonic acid esters include butyl crotonate and hexyl crotonate.

Suitable itaconic acid diesters include dimethyl itaconate, diethyl itaconate, and dibutyl itaconate.

Suitable maleic acid diesters include diethyl maleate, dimethyl maleate, and dibutyl maleate.

Suitable fumaric acid diesters include diethyl fumarate, dimethyl fumarate, and dibutyl fumarate.

Suitable acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, pnenylacrylamide, dimethylacrylamide, diethylacrylamide, β-cyanoethylacrylamide, and N-(2-acetoacetoxyethyl)acrylamide.

The methylacrylamide may be, for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, and N-(2-acetoacetoxyethyl)methacrylamide.

Suitable allyl compounds include allyl acetate, allyl caproate, allyl laurate, and allyl benzoate.

Suitable vinyl ethers include methyl vinyl ether, butyl vinyl ether, hexyl vinyl ether, methoxyethyl vinyl ether, and dimethylaminoethyl vinyl ether.

Suitable vinyl ketones include methyl vinyl ketone, phenyl vinyl ketone, and methoxyethyl vinyl ketone.

Suitable vinyl heterocyclic compounds include vinylpyridine, N-vinylimidazole, N-vinyloxaziidone, N-vinyltriazole, and N-vinylpyrrolidone.

Suitable glycidyl esters include glycidyl acrylate and glycidyl methacrylate.

Suitable unsaturated nitriles include acrylonitrile and methacrylonitrile.

Suitable multi-functional monomers include divinylbenzene, methylenebisacrylamide, and ethylene glycol dimethacrylate.

The hydrophilic group-containing polymer may be a copolymer having, for example, a mole ratio of methyl methacrylate/methacrylic acid of 1/1, as described in U.S. Pat. Nos. 2,992,102 and 3,767,448, the disclosures of which are herein incorporated by reference; a copolymer having a mole ratio of methyl methacrylate/methacrylic acid of 6/4 to 9/1, as described in JP-A-53-7231; a copolymer of ethyl methacrylate/methacrylic acid, as described in JP-A-58-66937; and a copolymer of ethyl methacrylate/methyl methacrylate/methacrylic acid, as described in JP-A-60-126644. Copolymers including a fluorine atom and a hydrophilic group as described in JP-A-62-14647 and 62-15543, are suitable for use in the present invention. Particles of the foregoing mentioned polymers are preferably used as a polymer-latex-1 according to the present invention but the present invention will not be limited thereto.

More Preferred examples of the polymer-latex-1 include a copolymer of methyl methacrylate and methacrylic acid having a ratio of 70/30 to 95/5, a copolymer of methyl methacrylate/methyl acrylate/methacrylic acid where the ratio of methyl acrylate/methacrylic acid is 60/40 to 95/5 and methyl acrylane is 0 to 50% based on the amount of methyl methacrylate.

The polymer latex-1 preferably contains 2 to 70 mole %, more preferably 3 to 50 mole %, and most preferably 5 to 40 mole %, of the hydrophilic group-containing monomer.

The average particle size of the polymer latex-1 is not less than 2.0 μm, preferably from 2 to 15 μm, and more preferably from 2 to 6 μm. The average particle size of the polymer latex of the present invention can be measured using Multi Particle Counter manufactured by COULTER ELECTRONICS, INC., an electron microscope, or utilizing light scattering.

The polymer latex-2, i.e., a crosslinked polymer latex having a hydrophilic group according to the present invention is preferably a copolymer including a repeating unit represented by the following Formula (II):

$$(A)_x (B)_y (C)_z \quad \text{(II)}$$

wherein A represents a monomer having a hydrophilic group; B represents a crosslinkable monomer; C represents a vinyl monomer other than B and C; and x, y and z represent a copoiymerization ratio, in which x is 0.1 to 30 mole %, y is 0.1 to 30 mole % and z is 0 to 95 mole %.

The monomer represented by A will now be explained.

In the present invention, the hydrophilic group is a group which makes the polymer easy to dissolve in water by introducing and includes a carboxyl group, a phosphoric acid group, a sulfonic acid group, a sulfuric acid group. Preferably, the hydrophillic group is a carboxyl group. Examples of suitable monomers having a carboxyl group include acrylic acid, methacrylic acid, itaconic acid, maleic acid, fumaric acid, itaconate, monoalkyl maleate, monoalkyl citraconic acid, and styrenecarboxylic acid. Phosphoric acid ester of hydroxyethyl acrylate is suitable for use as a monomer having the phosphoric acid group. Examples of suitable monomers having a sulfonic acid group include styrenesulfonic acid, methacryloyloxypropylsulfonic acid, and 2-acrylamide-2-methylpropanesulfonic acid. Sulfuric acid ester of hydroethyl acrylate is suitable for use as the monomer having a sulfuric acid group.

Acrylic acid and methacrylic acid are preferred as the monomer having a hydrophillic group (monomer A). Monomer A may contain two or more kinds of monomers.

Next, the crosslinkable monomer represented by B will be explained. Preferably, the crosslinkable monomer is a monomer having two or more ethylenically unsaturated groups capable of radical polymerization. For example, the crosslinkable polymer may be a polymerizable unsaturated carboxylic acid ester of polyhydric alcohol, a polymerizable unsaturated alcohol ester of polybasic acid, or an aromatic compound substituted with two or more vinyl groups. Examples of suitable crosslinkable polymers include ethylene glycol diacrylate, ethylene glycol dimethacrylate, triethylene glycol dimethacrylate, tetra-ethylene glycol dimethacrylate, 1,3-butylene glycol di-methacrylate, trimethylolpropane triacrylate, tri-methylolpropane trimethacrylate, 1,4-butanediol di-acrylate, neopentyl glycol diacrylate, 1,6-hexanediol diacrylate, pentaerythritol diacrylate, pennaerythritol triacrylate, pentaerythritol tetraacrylate, penta-erythritol dimethacrylate, pentaerythritol trimethacrylate, pentaerythritol tetramethacrylate, glycerol dimethacrylate, glycerol diacrylate, glycerol acroxydimethacrylate, 1,1,1-trishydroxymethylethane diacry-late, 1,1,1-trishydroxymethylethane triacrylate, 1,1,1-trishydroxymethylethane dimethacrylate, 1,1,1-trishydroxymethylethane trimethacrylate, 1,1,1-trishydroxymethylpropane diacrylate, 1,1,1-trishydroxymethylpropane triacrylate, 1,1,1-trishydroxymethylpropane dimethacrylate, 1,1,1-trishydroxymethylpropane trimethacrylate, triallyl cyanurate, triallyl isocyanurate, triallyl trimellitate, diallyl terephthalate, diallyl phthalate, and divinylbenzene.

Preferably, monomer B is ethylene glycol dimethacrylate, ethylene glycol diacrylate, or divinylbenzene.

Monomer B may contain two or more monomers.

Monomer C may be any suitable monomer as long as it is different from monomers A and B. For example, monomer C may be an acrylic acid ester, a methacrylic acid ester, a vinyl ester, an olefin, a styrene, a crotonic acid ester, a itaconic acid diester, a meleic acid diester, a acrylamide, a methacrylamide, an allyl compound, a vinyl ether, a vinyl ketone, a vinyl heterocyclic compound, or a glycidyl ester. Preferably, monomer C is an acrylic acid ester, a methacrylic acid ester, a vinyl ester, or a styrene.

Suitable acrylic acid esters include methyl acrylate, ethyl acrylate, n-propyl acrylate, iso-propyl acrylate, n-butyl acrylate, iso-butyl acrylate, sec-butyl acrylate, tert-butyl acrylate, amyl acrylate, and hexyl acrylate. Suitable methacrylic acid esters include methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, and octyl methacrylate. Suitable vinyl esters include vinyl acetate, vinyl propionate, vinyl butylate, vinyl iso-butylate, and vinyl caproate. Suitable styrene includes styrene, methylstyrene, dimethylstyrene, trimethylstyrene, ethylstyrene, iso-propylstyrene, chloromethylstyrene, and methoxystyrene. Suitable olefins include dicyclopentadiene, ethylene, propylene, 1-butene, 1-pentene, vinyl chloride, vinylidene chloride, isoprene, chloroprene, butadiene, and 2,3-dimethylbutadiene.

Preferably, monomer C is methyl methacrylate, ethyl methacrylate, styrene, methyl acrylate, or ethyl acrylate.

Monomer C may be two or more kinds of monomers the formula II:

x is 0.1 to 30 mole %, preferably 5 to 30 mole %, more preferably 10 to 25 mole %, and more preferably 15 to 25 mole %.

y is 0.1 to 30 mole %, preferably 1 to 25 mole %, more preferably 1 to 20 mole %, and more preferably 3 to 15 mole %.

z is 0 to 95 mole %, preferably 50 to 90 mole %, more preferably 60 to 89 mole %, and more preferably 60 to 84 mole %.

Examples of suitable the matting agent used in the present invention generally represented by Formula (II) are shown below but the present invention will not be limited thereto.

1. MMA/St/MAA/EGDM=36/36/20/8 (mole %)
2. MMA/MAA/EGDM=75/20/5
3. MMA/MA/MAA/EGDM=60/15/15/10
4. MMA/MAA/DVB=75/20/5
5. MMA/MAA/EGDM=70/25/5
6. MMA/MAA/EGDM=70/20/10
7. EMA/AA/DVB=80/15/5
8. EMA/EA/AA/EGDM=35/35/20/10
9. MMA/MAA/EGDA=75/20/5 wherein

MMA: methyl methacrylate
MA: methyl acrylate
MAA: methacrylic acid
AA: acrylic acid
EMA: ethyl methacrylate
EA: ethyl acrylate
St: styrene EGDM: ethylene glycol dimethacrylate
DVB: divinylbenzene
EGDA: ethylene glycol diacrylate The average particle size of the polymer-latex-2 to be used in the present invention is preferably 2 to 15 μm, more preferably 2 to 6 μm.

The coated amount of the matting agent according to the present invention (including polymer-latex-1 and polymer-latex-2) to be contained in the surface protective layer, is preferably 0.001 to 0.3 g/m², more preferably 0.01 to 0.15 g/m².

The amount of the polymer-latex-1 incorporated in the surface protective layer is preferably at least 30 weight %, more preferably at least 50 weight % based on the whole coated amount of the used matting agents. Any suitable alkali insoluble matting agent may be used in combination therewith. This agent may be, for example, an organic compound such as poly-methyl methacrylate and polystyrene, or an inorganic compound such as silicon dioxide. Further, two or more kinds of the matting agents according to the present invention may be used in the present invention.

Preferably, the surface protective layer includes the mattinig agent according to the present invention in an amount of at least 70 weight %, more preferably at least 80 weight %, and more preferably at least 90 weight % based on the amount of the whole matting agent used on one side of the support of the light-sensitive material.

Particularly preferred is the one having the maximums in a particle size distribution in the ranges of 3 μm or more and 3 μm or less. This is because while the matting agent having the average particle size of 3 μm or more controls the peeling property of a light-sensitive material, the matting agent having the average particle size of 3 μm or less controls mainly the sliding property and glossiness of the light-sensitive material. Usually, what causes settling in a coating solution and peeling off in a processing is this particle of 3 μm or more. This component of 3 μm or more is particularly effective in the present invention.

A preferred particle size distribution in the matting agent according to the present invention is shown in the Figure.

The silver halide photographic material of the present invention preferably includes a coated amount of gelatin of up to 0.8 g/m², more preferably from 0.3 to 0.8 g/m², present in the surface protective layer containing the matting agent according to the present invention.

The silver halide photographic material of the present invention preferably includes a water soluble polymer contained in the surface protective layer containing the matting agent according to the present invention, and the coated amount thereof is at least 10 wt % based on the whole coated gelatin amount on the side having the surface protective layer containing the matting agent of the present invention.

The silver halide photographic material of the present invention preferably includes one or more of the compounds represented by the following Formulas (I-1), (I-2) and (I-3) contained in the surface protective layer containing the matting agent according to the present invention, in the amount of 20 mg/m² or more:

$$R_1-A-(CH_2CH_2O)_{n1}-H \qquad \text{I-1}$$

-continued

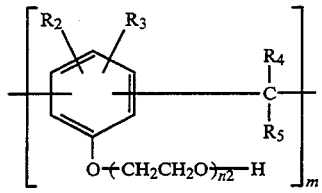

I-2

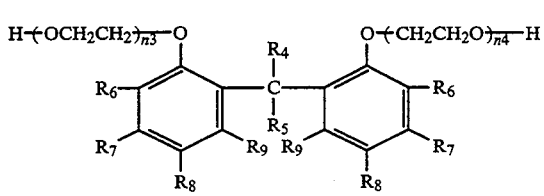

I-3

In the foregoing formulas I-1, I-2 and I-3, $R_1$ represents a substituted or unsubstituted alkyl group having 1 to 30 carbon atoms, a substituted or unsubstituted alkenyl group having 1 to 30 carbon atoms, or a substituted or unsubstituted aryl group having 6 to 30 carbon atoms, and A repre-sents a —O— group, a —S— group, a —COO— group, a —N($R_{10}$)— group, a —CO—N($R_{10}$)— group, or a —$SO_2$—N($R_{10}$)— group, where $R_{10}$ represents a hydrogen atom or a substituted or unsubstituted alkyl group.

$R_2$, $R_3$, $R_7$ and $R_9$ each represents a hydrogen atom, a substituted or unsubstituted alkyl group, a substituted or unsubstituted aryl group, a substituted or unsubstituted alkoxy group, a halogen atom, a substituted or unsubstituted acyl group, an amide group, a sulfonamide group, a carbamoyl group, or a sufamoyl group.

$R_6$ and $R_8$ each represents a substituted or unsubstituted alkyl group, a substituted or unsubstituted aryl group, a substituted or unsubstituted alkoxy group, a halogen atom, a substituted or unsubstituted acyl group, an amide group, a sulfonamide group, a carbamoyl group, or a sufamoyl group. In Formula (I-3), the substituents on the phenyl rings ($R_6$, $R_7$, $R_8$ and $R_9$) may be laterally asymmertic.

$R_4$ and $R_5$ each represents a hydrogen atom, a substituted or unsubstituted alkyl group, or a substituted or unsubstituted aryl group. $R_4$ and $R_5$, $R_6$ and $R_7$, and $R_8$ and $R_9$ may be combined with each other to form a substituted or unsubstituted ring. $n_1$, $n_2$, $n_3$ and $n_4$ are the average polymerization degrees of ethylene oxide and each are 2 to 50. m is an average polymerization degree and is the number of 2 to 50.

The addded amount of the compound represented by formula (I-1), (I-2) or (I-3) is more preferably from 20 to 100 mg/m², most preferably from 20 to 60 mg/m².

Formulas (I-1), (I-2) and (I-3) will be explained in further details.

$R_1$ is preferably an alkyl group, an alkenyl group, or an alkylaryl group, each having 4 to 24 carbon atoms, and more preferably hexyl, dodecyl, isosteraryl, oleyl, t-butylphenyl, 2,4-di-t-butylphenyl, 2,4-di-t-pentylphenyl, p-dodecylphenyl, m-pentadecaphenyl, t-octylphenyl, 2,4-dinonylphenyl, or octylnaphthyl. $R_2$, $R_3$, $R_6$, $R_7$, $R_8$ and $R_9$ are each preferably: a substituted or unsubstituted alkyl group having 1 to 20 carbon atoms, such as methyl, ethyl, i-propyl, t-butyl, t-amyl, t-hexyl, t-octyl, nonyl, decyl, dodecyl, trichloromethyl, tribromomethyl, 1-phenylethyl, and 2-phenyl-2-propyl; a substituted or unsubstituted aryl group such as phenyl and p-chlorophenyl; a substituted or unsubstituted alkoxy group represented by —$OR_{11}$, where $R_{11}$ represents a substituted or unsubstituted alkyl group having 1 to 20 carbon atoms, or an aryl group; a halogen atom, such as a chlorine atom and a bromine atom; an acyl group represented by —$COR_{11}$, where $R_{11}$ is as defined above an amide group represented by —$NR_{12}COR_{11}$, where $R_{12}$ represents a hydrogen atom or an alkyl group having 1 to 20 carbon atoms; a sulfonamide group represented by —$NR_{12}SO_2R_{11}$, where $R_{11}$ and $R_{12}$ are as defined above; a carbamoyl group represented by —$CON(R_{12})_2$, where $R_{12}$ is as defined above, or a sulfamoyl group represented by —$SO_2N(R_{12})_2$, where $R_{12}$ is as defined above $R_2$, $R_3$, $R_7$ and $R_9$ may be a hydrogen atom. $R_6$ and $R_8$ are each preferably an alkyl group or a halogen atom, more preferably a tertiary alkyl group such as bulky t-butyl, t-amyl, and t-octyl. $R_7$ and $R_9$ are more preferably a hydrogen atom. The compound of Formula (I-3) synthesized from 2,4-disubstituted phenol is particularly preferred.

$R_4$ and $R_5$ are each preferably a hydrogen atom, a substituted or unsubstituted alkyl group, such as methyl, ethyl, n-propyl, i-propyl, n-hepyl, 1-ethylamyl, n-undecyl, trichloromethyl, and tribromomethyl, or a substituted or unsubstituted aryl group such as α-furyl, phenyl, naphthyl, p-chlorophenyl, p-methoxyphenyl, and m-nitrophenyl. $R_4$ and $R_5$, $R_6$ and $R_7$, and $R_8$ and $R_9$ may be combined with each other to form a substituted or un-substituted ring, for example, a cyclohexyl ring. $R_4$ and $R_5$ are more preferably a hydrogen atom, an alkyl group having 1 to 8 carbon atoms, a phenyl group, and a furyl group. $n_1$, $n_2$, $n_3$ and $n_4$ are more preferably 5 to 30. $n_3$ and $n_4$ may be the same or different.

Examples of suitable polyalkylene oxide compounds which may be used in the present invention for the compound of formulas I-1, I-2 and I-3 include:

$C_{11}H_{23}COO(CH_2CH_2O)_8H$ I-1

$C_{17}H_{33}COO(CH_2CH_2O)_{15}H$ I-2

$C_{12}H_{25}O(CH_2CH_2O)_{10}H$ I-3

$C_{18}H_{35}O(CH_2CH_2O)_{16}H$ I-4

I-5

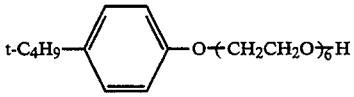

I-6

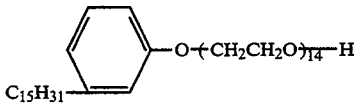

I-7

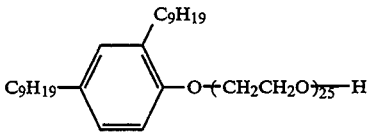

I-8

$C_{13}H_{27}CON(CH_2CH_2O)_{12}H$ ($CH_3$ on N)

$C_{12}H_{25}S(CH_2CH_2O)_{16}H$ I-9

-continued $C_{12}H_{25}O(CHCH_2O)_3(CH_2CH_2O)_{15}H$ ($CH_3$) I-10

I-11

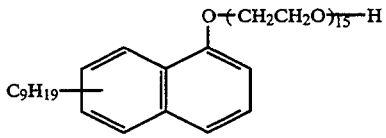

$C_8H_{17}O(CH_2CH_2O)_7H$ I-11a $C_{16}H_{33}O(CH_2CH_2O)_{12}H$ I-11b

I-11c

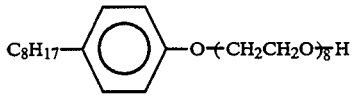

I-12

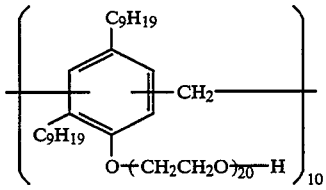

I-13

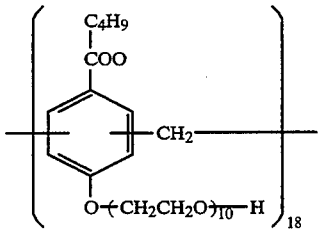

I-13a

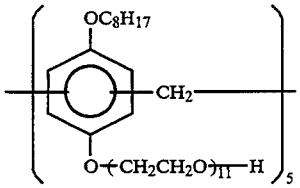

I-14

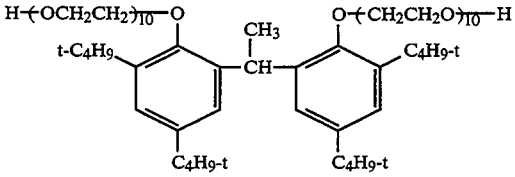

I-15

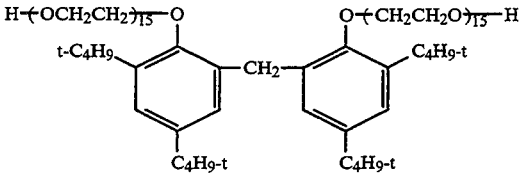

-continued
I-16
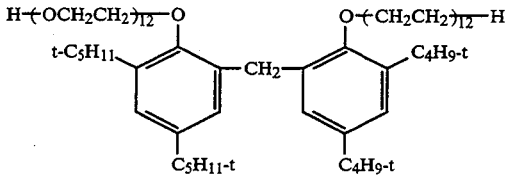
I-17
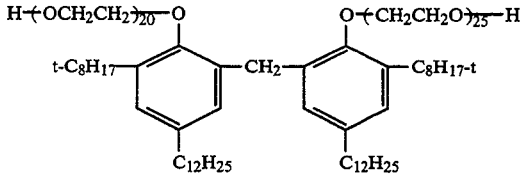
I-18
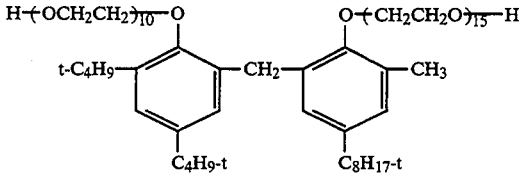
I-19
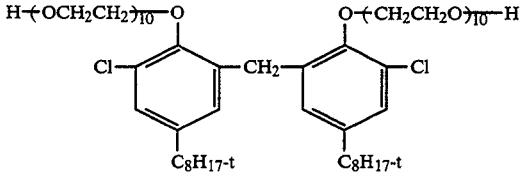
I-20
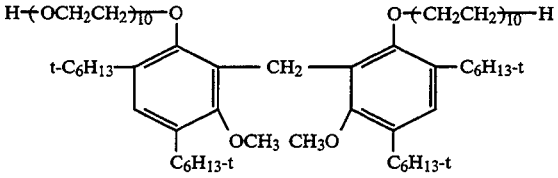
I-21
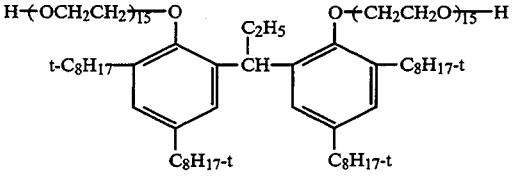
I-22
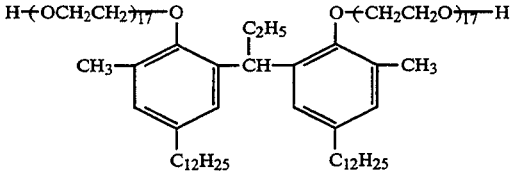
-continued
I-23
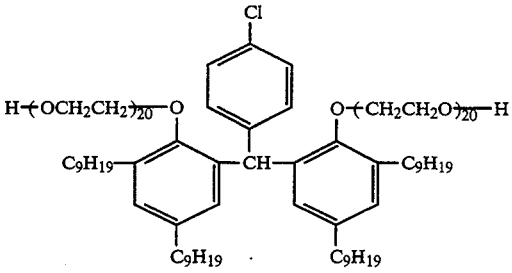
I-24
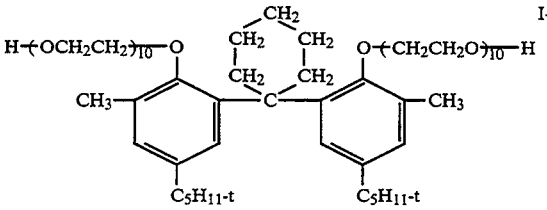
I-25
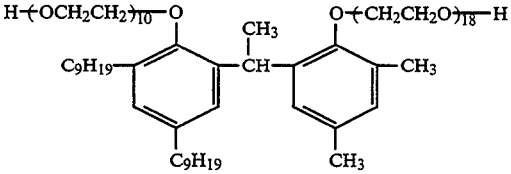
I-26
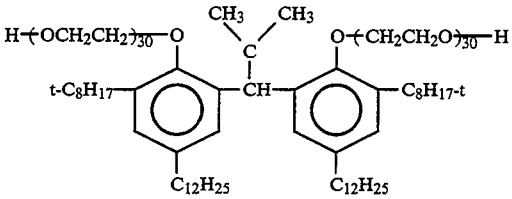
I-27
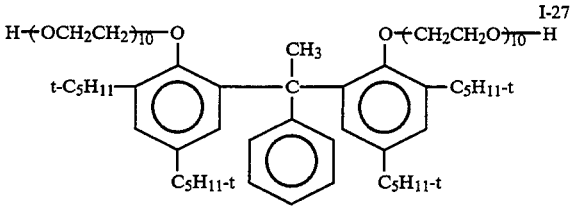
I-28
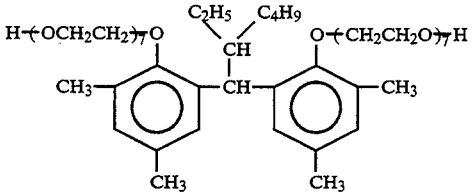
I-29
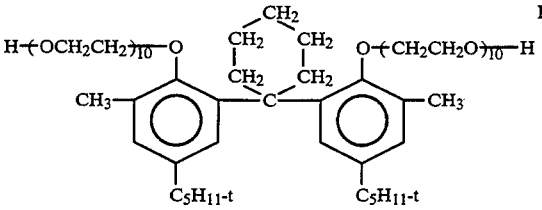

-continued

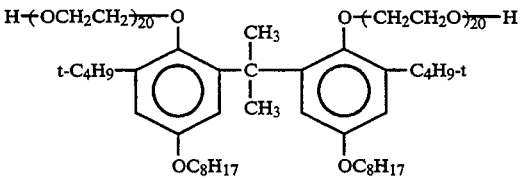

I-30

Any suitable water soluble polymer may be used in the present invention. For example, a synthetic water soluble polymer or a natural water soluble polymer may be used. Suitable synthetic water soluble polymers may include a nonionic group, an anionic group, or a nonionic group and an anionic group in a molecular structure. The nonionic group may be, for example, an ether group, an ethylene oxide group, or a hydroxy group. The anionic group may be, for example, a sulfonic acid group or the salt thereof, a carboxylic acid group or the salt thereof, or a phosphoric acid group or the salt thereof. The natural water soluble polymer may include a nonionic group, an anionic group, and a nonionic group and an anionic group in a molecular structure.

A polymer having an anionic group, or a polymer having a nonionic group and an anionic group, is preferably used as the synthetic or natural water soluble polymer. The water soluble polymer dissolves in 100 g of water at 20° C. in an amount of at least 0.05 g, preferably at least 0.1 g.

Further, the water soluble polymer according to the present invention has a high solubility to both developing and fixing solutions. Preferably, the solubility (at 35° C., the developing temperature or the fixing temperature) of the water soluble polymer is at least 0.05 g, more preferably at least 0.5 g, and most preferably at least 1 g per 100 g of the developing solution. A suitable synthetic water soluble polymer contains 10 to 100 mole % of the repeating unit represented by the following Formula (P) in one molecule of the polymer:

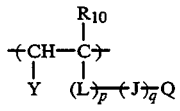

(P)

wherein $R_{10}$ represents a hydrogen atom, a substituted or unsubstituted alkyl group, the alkyl group preferably having 1 to 4 carbon atoms (where the allyl group may substituted with, or example, a methyl group, an ethyl group, a propyl group, or a butyl group), a halogen atom (for example, a chlorine atom), or —$CH_2COOM$; L represents —CONH—, —NHCO—, —COO—, —OCO—, —CO—, or —O—; J represents an alkylene group, preferably an alkylene group having 1 to 10 carbon atoms (where the alkyl group may be substituted, for example, methylene, ethylene, propylene, trimethylene, butylene, and hexylene), an arylene group (where the arylene group may be substituted, for example, phenylene), or

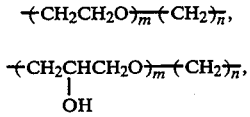

m represents an integer of 0 to 40, and n represents an integer of 0 to 4.

or Q represents

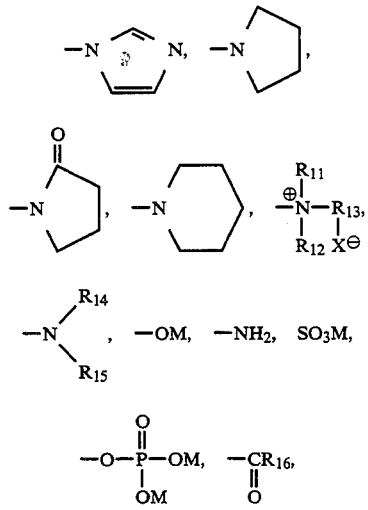

a hydrogen atom or $R_{17}$

M represents a hydrogen atom or a cation; R16 represents an alkyl group having 1 to 4 carbon atoms (for example, a methyl group, an ethyl group, a propyl group, and a butyl group); $R_{17}$, $R_{11}$, $R_{12}$, $R_{13}$, $R_{14}$ and $R_{15}$ each represents an alkyl group having 1 to 20 carbon atoms (for example, a methyl group, an ethyl group, a propyl group, a butyl group, a hexyl group, a decyl group, and a hexadecyl group), an alkenyl group (for example, vinyl and aryl), a phenyl group (for example, phenyl, methoxyphenyl, and chlorophenyl), or an aralkyl group (for example, benzyl); X represents an anion; and p and q each represents 0 or 1. A polymer containing acrylamide or methacrylamide is preferred.

Examples of the suitable synthetic water soluble polymer including a repeating unit represented by Formula [P] include:

| | | Mean molecular weight |
|---|---|---|
| P-1 | 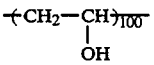 | 8,000 |
| P-2 | 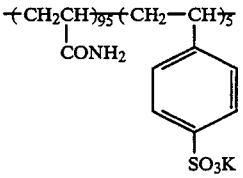 | 15,000 |
| P-3 | 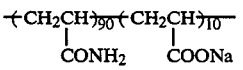 | 9,000 |
| P-4 | 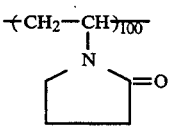 | 3,100 |

-continued

| | Mean molecular weight |
|---|---|
| P-5 $\leftarrow CH_2-CH\rightarrow_{100}$ (CONH$_2$) | 3,000 |
| P-6 $\leftarrow CH_2-CH\rightarrow_{100}$ (CONH$_2$) | 8,000 |
| P-7 $\leftarrow CH_2-C\rightarrow_{100}$ ($CH_3$; $COO\leftarrow CH_2CHCH_2O\rightarrow_{75}CH_3$, OH) | 10,000 |
| P-8 $\leftarrow CH_2-CH\rightarrow_{95}\leftarrow CH_2-CH\rightarrow_{5}$ (OH; $OCOCH_3$) | 9,000 |
| P-9 $\leftarrow CH_2-CH\rightarrow_{98}\leftarrow CH_2-CH\rightarrow_{2}$ (CONH$_2$; COOH) | 12,000 |
| P-10 $\leftarrow CH_2-CH\rightarrow_{90}\leftarrow CH_2-CH\rightarrow_{10}-CH_2$ ($COOCH_2CH_2OH$; CONH $CCH_2SO_3Na$, $CH_3$) | 8,000 |
| P-11 $\leftarrow CH_2-CH\rightarrow_{n}$ ($CH_2NH_2$) | 11,000 |
| P-12 $\leftarrow CH_2-CH\rightarrow$ (CONH$-C_3H_7$-iso) | 6,000 |
| P-13 $\leftarrow CH_2-CH\rightarrow$ ($SO_3Na$) | 7,800 |
| P-14 $\leftarrow CCH=CHCO(CH_2)_6O\rightarrow_{n1}\leftarrow CCHCH_2CO(CH_2)_6O\rightarrow_{n2}$ ($SO_3Na$) | |

$n_1:n_2$=50 mol %:50 mol % number average molecular weight (Mn): about 10,000

The synthetic water soluble polymer according to the present invention preferably has the molecular weight of 1,000 to 100,000, more preferably 2,000 to 50,000.

Preferably, the natural synthetic water soluble polymer is a glucose polymer or a derivative thereof, more preferably, starch, glycogen, cellulose, lichenan, dextran, or nigerant and more preferably, dextran or a derivative thereof.

Preferably, the natural water soluble polymers have the molecular weight of 1000 to 100,000, more preferably 2000 to 50,000.

The synthetic or natural water soluble polymer may be incorporated into the photographic material of the present invention in an amount of preferably at least 10%, more preferably from 10% to 30 based on the amount of the whole coated amount of gelatin on the side having the surface protective layer of the present invention.

Other various additives and techniques conventionally used for manufacturing light-sensitive material according to the present invention may be used in the present invention, such as the ingredious and techniques identified below and described in the documents also identified below: described in the corresponding portions shown below can be used.

| Ingredient/Technique | Document |
|---|---|
| 1) Silver halide emulsion and manufacturing method thereof | Right lower column, line 6 from bottom at p. 8 to right upper column, line 12 at p. 10 of JP-A-2-68539; right lower column, line 10 at p. 2 to right upper column, line 1 at p. 6 and left upper column, line 16 at p. 10 to left lower column, line 19 at p. 11 of JP-A-3-24537; and JP-A-4-107442. |
| 2) Chemical sensitization method | Right upper column, line 13 to left upper column, line 16 at p. 10 of JP-A-2-68539; and Japanese patent application 3-105035. |
| 3) Anti-fogging agent, & stabilizer | Left lower column, line 17 at p. 10 to left upper column, line 7 at p. 11 and left lower column, line 2 at p. 3 to left lower column at p. 4 of JP-A-2-68539. |
| 4) Color tone improving agent | Left lower column, line 7 at p. 2 to left lower column, line 20 at p. 10 of JP-A-62-276539, and left lower column, line 15 at p. 6 to right upper column, line 19 at p. 11 of JP-A-3-94249. |
| 5) Spectral sensitizing dye | Right lower column, line 4 at p. 4 to right lower column at p. 8 of JP-A-2-68539. |
| 6) Surface active agent, & anti-electrification agent | Left upper column, line 14 at p. 11 to left upper column, line 9 at p. 12 of JP-A-2-68539. |
| 7) Sliding agent, & plasticizer | Left upper column, line 10 to right upper column, line 10 at p. 12 and left lower column, line 10 to right lower column, line 1 at p. 14 of JP-A-2-68539. |
| 8) Hardener | Left lower column, line 17 at p. 12 to right upper column, line 6 at P. 13 of JP-A-2-68539. |
| 9) Support | Right upper column, lines 7 to 20 at p. 13 of JP-A-2-68539. |
| 10) Crossover cutting method | Right upper column, line 20 at p. 4 to right upper column at p. 14 of JP-A-2-264944. |
| 11) Dye and mordant | Left lower column, line 1 at p. 13 to left lower column, line 9 at p. 14 of JP-A-2-68539; and left lower column at p. 14 to right lower column at p. 16 of JP-A-3-24537. |
| 12) Polyhydroxybenzenes | Left upper column at P. 11 to left lower column at p. 12 of JP-A-3-39948, and EP Patent 452772A. |
| 13) Layer structure | JP-A-3-198041. |
| 14) Development processing method | Right upper column, line 7 at p. 16 to left lower column, line 15 at p. 19 of JP-A-2-103037; and right lower column, line 5 at p. 3 to right upper column, line 10 at p. 6 of JP-A-2-115837. |

EXAMPLES

The invention will now be described in connection with examples thereos, it being understood that the invention is not limited thereto.

EXAMPLE 1

Preparation of the tabular grains 6 g of potassium bromide and 7 g of low molecular weight gelatin having the average molecular weight of 15,000 were added to 1 liter of water, and 37 ml of a silver nitrate aqueous solution (silver nitrate: 4.00 g), and 38 ml of an aqueous solution 38 ml containing 5.9 g of potassium bromide were added to the above solution kept at 55 ° C. by a double jet method for 37 seconds while stirring. Next, 18.6 g of gelatin were added and then 89 ml of a silver nitrate aqueous solution (silver nitrate: 9.80 g) was added over a period of 22 minutes after the temperature was raised to 70° C. Then 7 ml of a 25% ammonia aqueous solution was added to provide a physical ripening for 10 minutes while maintaining keeping the temperature, and then 6.5 ml of a 100% acetic acid solution was added. Subsequently, 153 g of the aqueous solution of silver nitrate and the aqueous solution of potassium bromide were added by a controlled double jet method over a period of 35 minutes while maintaining pAg at 8.5. Then, 15 ml of a 2N potassium thiocyanate aqueous solution was added. After providing a physical ripening for 5 minutes while maintaining the temperature, the temperature was then lowered to 35° C. Thus, mono-dispersed pure silver bromide tabular grains were obtained having an average projected area-corresponding circle diameter of 1.10 μm, an average thickness of 0.165 μm, an average aspect ratio of 6.7, and a diameter fluctuation coefficient of 18.5%.

Thereafter, the soluble salts were removed by a settling method. The temperature was raised once again to 40° C. and 30 g of gelatin, 2.35 g of phenoxy ethanol, and 0.8 g of poly(sodium styrenesulfonate) as a thickener, were added followed by adjusting pH and pAg to 5.90 and 8.00, respectively, with caustic soda and a silver nitrate solution.

This emulsion was subjected to a chemical sensitization while stirring and maintaining the temperature at 56° C.

First, $1\times10^{-5}$ mole/mole Ag of the following thiosulfonic acid compound-1 was added:

Thiosulfonic acid compound-1

$C_2H_5SO_2SNa$ and further 0.043 mg of thiourea dioxide was added and the emulsion was left standing for 22 minutes to subject it to a reduction sensitization. Next, AgI fine grains having the average sphere-corresponding size of 0.03 μm were added in an amount corresponding to 0.2 mole % per mole of silver halide. Then, 20 mg of 4-hydroxy-6-methyl-1,3,3a,7-tetrazaindene and the sensitizing dyes:

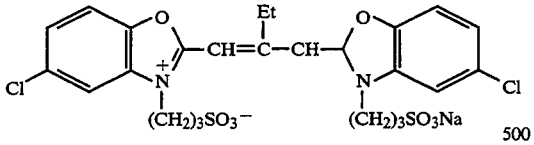

500 mg

-continued

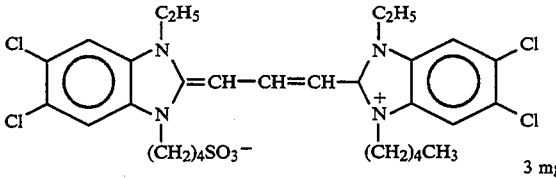

3 mg were added. Further, potassium chloride 0.83 g was added. Subsequently, there were added sodium thiosulfate 1.3 mg and the selenium compound-1 2.7 mg, and further chlorauric acid 2.6 mg and potassium thiocyanate 90 mg were added. The solution was cooled down to 35° C. 40 minutes later.

Selenium compound-1

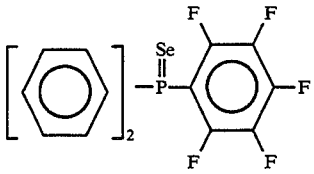

Thus, the tabular grains T-1 were prepared.

Preparation of the coated samples

The following compounds per mole of silver halide were added to prepare the coating solutions for preparing the coated samples.

| | |
|---|---|
| Gelatin (including gelatin contained in an emulsion) | 108 g |
| Trimethylol propane | 9 g |
| Dextrane (average molecular weight: 39,000) | 18.5 g |
| Poly(sodium styrenesulfonate) (an average molecular weight: 600,000) | 1.8 g |
| Hardener/1,2-bis(vinylsulfonylacetoamide)ethane the addition amount was adjusted so that a swelling ratio became 230%. | |
| 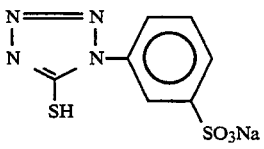 | 34 mg |
| 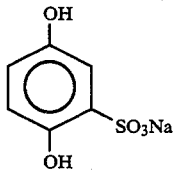 | 4.8 g |
| 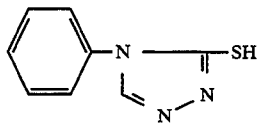 | 30 mg |

A surface protective layer was coated so that the coated amounts of the respective components became as shown below:

| Composition of the surface protective layer | Coated amount |
|---|---|
| Gelatin | 0.900 g/m$^2$ |
| Poly(sodium acrylate) (average molecular weight: 400,000) | 0.023 g/m$^2$ |
| 4-Hydroxy-6-methyl-1,3,3a,7-tetrazaindene | 0.015 g/m$^2$ |
| 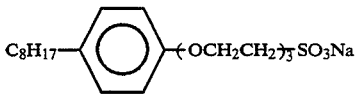 | 0.013 g/m$^2$ |
| $C_{16}H_{33}O(CH_2CH_2O)_{10}H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)(CH_2CH_2O)_{15}H$ | 0.003 g/m$^2$ |
| $C_8F_{17}SO_2N(C_3H_7)(CH_2CH_2O)_4(CH_2)_4SO_3Na$ | 0.001 g/m$^2$ |
| Proxel (pH was adjusted to 7.4 with NaOH) | 0.0005 g/m$^2$ |

Next, the kind of the matting agent added was changed as shown in Table 1 and water was added so that the viscosity of the coating solution became 0.25 poise to thereby prepare the coating solution. Then, the coating solution was applied so that the coated amount of the matting agent became 0.1 g/m$^2$, whereby the test coated samples 1 to 8 were prepared.

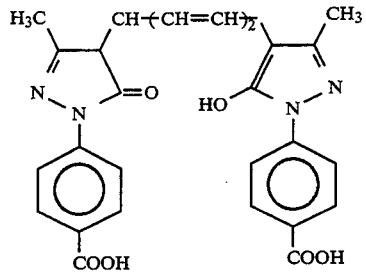

Water 434 ml and the 6.7% aqueous solution 791 ml of the surface active agent Triton X-200 (TX-200) were put in a 2 liter ball mill and the dye 20 g was added to this solution. The beads 400 ml (diameter: 2 mm) of zirconium oxide (ZrO) were put therein and the content was crashed for 4 days. Then, a 12.5% gelatin aqueous solution 160 g was added, and after defoaming, the mixture was filtered to remove the ZrO beads. The observation of the dye dispersion thus obtained showed that the particle sizes of the crashed dye were distributed in the wide range of 0.05 to 1.15 μm and that the average particle size was 0.37 μm.

Further, a centrifugal procedure was applied to remove the dye particles having the sizes of 0.9 μm or more. Thus, the dye dispersion D-1 was obtained.

(2) Preparation of a support:

The surface of a biaxially stretched polyethylene terephthalate film with the thickness of 183 μm was subjected to a corona discharge treatment, and the first subbing layer coating solution having the following composition was coated thereon with a wire bar coater

TABLE 1

| Matting agent No. | Average grain size | Presence of peak of 3 μm or more | Settling amount* | Matting agent component |
|---|---|---|---|---|
| 1 (Comparison) | 1.8 | Presence | A: 10% | MMA/MA/MAA = 70/20/10 |
| | | | B: 5% | M.W.: 20,000 |
| 2 (Comparison) | 2.2 | Presence | A: 45% | MMA/MA/MAA = 80/15/5 |
| | | | B: 40% | M.W.: 22,000 |
| 3 (Invention) | 2.2 | Presence | A: 5% | MMA/MA/MAA = 65/20/15 |
| | | | B: 5% | M.W.: 24,000 |
| 4 (Invention) | 3.2 | Presence | A: 25% | MMA/MA/MAA = 83/10/7 |
| | | | B: 20% | M.W.: 30,000 |
| 5 (Comparison) | 3.2 | Presence | A: 35% | MMA/MA/MAA = 81/15/4 |
| | | | B: 25% | M.W.: 21,000 |
| 6 (Invention) | 3.2 | None | A: 14% | MMA/MAA = 90/10 |
| | | | B: 10% | M.W.: 24,000 |
| 7 (Invention) | 3.2 | Presence | A: 5% | MMA/ST/BA/MA/MAA = 10/30/30/10/20 |
| | | | B: 5% | M.W.: 30,000 |
| 8 (Comparison) | 3.2 | Presence | A: 55% | MMA/MAA = 80/20 |
| | | | B: 40% | M.W.: 22,000 |

*A: matting agent test amount by the test method described in claim 1.

B: settling amount of the matting agent in the surface protrective layer coating solution after leaving for standing at 40° C. for 24 hours.

MMA: methyl methacrylate, MA: methyl acrylate, MAA: methacrylic acid, ST: styrene, BA: butyl acrylate (ratio: weight %).

A support was prepared in the following manner.

Preparation of a support (1) Preparation of the dye dispersion D-1 for coating a subbing layer:

The dye shown below was treated with a ball mill by the method described in JP-A-63-197943.

so that the coated amount thereof became 5.1 ml/m$^2$, followed by drying at 175° C. for one minute.

Next, the first subbing layer was provided as well on the opposite side of the support in the same manner. Polyethylene terephthalate containing 0.04 wt % of the dye having the following chemical structure was used:

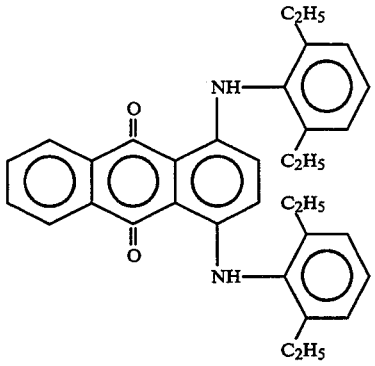

| | |
|---|---|
| Butadiene-styrene copolymer latex solution (the solid content: 40%, butadiene/styrene weight ratio: 31/69) | 79 ml |
| Sodium 2,4-dichloro-6-hydroxy-s-triazine (4% solution) | 20.5 ml |
| Distilled water | 900.5 ml |

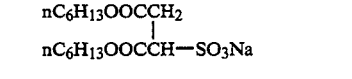

was contained as an emulsion dispersant in the latex solution in a proportion of 0.4 wt % based on a latex solid content The second subbing layers having the following composition were applied layer by layer on the above first subbing layers on the both sides with the wire bar coater so that the coated amounts of the respective components became as shown below, followed by drying at 150° C.:

| | |
|---|---|
| Gelatin | 160 mg/m$^2$ |
| Dye dispersion D-1 (as the solid content of the dye) | 26 mg/m$^2$ |
| 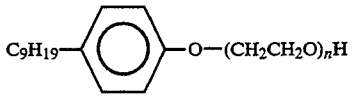 | 8 mg/m$^2$ |
| 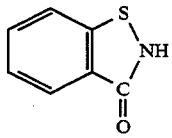 | 0.27 mg/m$^2$ |
| Matting agent (polymethyl methacrylate with the average grain size of 2.5 μm) | 2.5 mg/m$^2$ |

Preparation of a photographic material

The foregoing emulsion layer and surface protective layer were provided on the both sides of the support prepared above by a simultaneous extrusion method. The coated silver amount per one side was set at 1.75 g/m$^2$. A coated gelatin amount and a swelling rate determined by a freeze drying method with liquid nitrogen were controlled by gelatin added to the emulsion layer and a hardener amount.

Processing:

Automatic processor: a driving motor and a gear of FPM-9000 manufactured by Fuji Photo Film Co., Ltd. were modified to accelerate a transporting speed.

| | |
|---|---|
| Developing solution condensate: | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-l-phenyl-3-pyrazolidone | 22.0 g |
| 5-Methylbenzotriazole | 2 g |
| 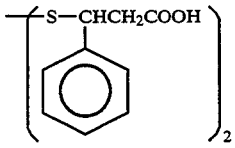 | 0.6 g |
| Water was added to (pH was adjusted to 10.60) | 1 liter |
| Fixing solution condensate: | |
| Ammonium thiosulfate | 560 g |
| Sodium sulfite | 60 g |
| Disodium ethylenediaminetetraacetate dehydrate | 0.10 g |
| Sodium hydroxide | 24 g |
| Water was added to (pH was adjusted to 5.10 with acetic acid) | 1 liter |

Before development processing was started, the processing solutions shown below were filled in the respective tanks of the automatic processor.

Developing tank: 10 ml of a starter containing 33 l of the above developing solution condensate, 667 ml of water, 2 g of potassium bromide and 1.8 g of acetic acid were added and pH was adjusted to 10.25.

Fixing tank: 200 ml of the above fixing solution condensate and 800 ml of water.

Processing speed: 35 seconds on Dry to Dry.

Developing temperature: 35° C.

Fixing temperature: 32° C.

Drying temperature: 55° C.

Replenishing amount developing solution: 22 ml/10×12 inch fixing solution: 30 ml/10×12 inch The respective coated light-sensitive materials thus prepared were cut to 600 sheets each with a size of 18 cm×38 cm and each thereof was subjected to a running processing with the automatic processor Model CE-PROS-M and an automatic feeder without replenishing the fixing solution. After processing 600 sheets, 1 liter of the fixing solution was sampled and filtered with an FM-22, 47-00 filter. The weight of the filtered matters was measured to obtain the results shown in Table 2. The filtered residue was observed with a microscope and analyzed with infrared spectroscopy to confirm that it was matting agent.

There was summarized as well in Table 2, the frequency inferior transportation caused when the respective light-sensitive materials were subjected to the running test under the conditions of 25° C. and 25% RH. The term "inferior transportation" as used herein means that plural sheets are sent at the same time in transporting a film and that the film gets caught during transporting with a roller. It will be appreciated from the results shown in Table 2 that the light-sensitive materials according to the present invention exhibit less peeling off and eluting of the matting agent and have excellent transporting performance.

TABLE 2

| | Matting agent amount in the fixing solution | Frequency of bad transportion |
|---|---|---|
| 1 | 0.04 g/liter | 10 |
| 2 | 0.11 g/liter white turbidity in the fixing solution | 4 |
| 3 | 0.03 g/liter | 2 |
| 4 | 0.03 g/liter | 0 |
| 5 | 0.06 g/liter | 1 |
| 6 | 0.025 g/liter | 2 |
| 7 | 0.15 g/liter | 0 |
| 8 | 0.15 g/liter white turbidity in the fixing solution | 2 |

EXAMPLE 2

The light-sensitive materials 2-1 to 2-8 corresponding to the light-sensitive materials 1 to 8 prepared in Example 1 were prepared in the same manners as those in Example 1, except that the coated amount of gelatin contained in the surface protective layer coating solution was changed to 0.65 g/m$^2$. They were subjected to a surface protective layer coating solution settling test and the tests of matting agent peeling off and an inferior transportation in a running processing in the same manner as those in Example 1, whereby the results shown in Table 3 were obtained. Again, the light-sensitive materials of the present invention preformed excellently particularly with the reduced coating amount of gelatin.

TABLE 3

| Coated sample | Matting agent* | Matting agent** | Frequency of bad transportation |
|---|---|---|---|
| 2-1 | 15% | 0.06 g/l | 15 |
| 2-2 | 70% | 0.20 g/l | 8 |
| 2-3 | 5% | 0.35 g/l | 2 |
| 2-4 | 25% | 0.04 g/l | 2 |
| 2-5 | 60% | 0.17 g/l | 8 |
| 2-6 | 10% | 0.03 g/l | 1 |
| 2-7 | 5% | 0.015 g/l | 0 |
| 2-8 | 80% | 0.3% g/l | 10 |

*: Settling amount.
**: Amount in the fixing agent.

EXAMPLE 3

The coating solutions and the light-sensitive materials 3-1 to 3-8 corresponding to the light-sensitive materials 1 to 8 prepared in Example 1 were prepared in the same manner as those in Example 1, except that the coated amount of the following compound:

$$C_{16}H_{33}O\text{-}(CH_2CH_2O)_{10}\text{-}H$$

contained in the surface protective layer coating solution was reduced to the level corresponding to a coated amount of 15 mg/m$^2$. These coating solutions were evaluated by the same settling method as that in Example 1 to find that the matting agent precipitated only in an amount of up to 10%. Meanwhile, these light-sensitive materials were subjected to processing with the automatic processor described in Example 1 at 25° C. and 10% RH to find that any of the light-sensitive materials had the generation of a static mark and was fogged. Accordingly, it was confirmed that the decrease in the content of polyethylene oxide could not prepare the light-sensitive materials preferred in terms of a handling performance while the settling in the coating solution could be prevented.

EXAMPLE 4

The light-sensitive materials of the present invention described in Examples 1 and 2 were subjected to the following evaluation of photographic performances.

Evaluation of the photographic performances

The X ray ortho-screen HR-4 manufactured by Fuji Photo Film Co., Ltd. was used to expose the light sensitive material for 0.05 second on both sides and evaluation was carried out.

The automatic processor Model FPM-9000 manufactured by Fuji Photo Film Co., Ltd. was modified to use it for this experiment. The processing steps therefor are shown in the following Table 4.

TABLE 4

| Processing step | Processing bath solution amount | Processing temperature | Processing path length | Processing time |
|---|---|---|---|---|
| Developing | 15 liter | 35° C. | 613 mm | 8.8 seconds |
| | (solution surface area to processing bath volume ratio = 25 cm$^2$/liter) | | | |
| Fixing | 15 liter | 32° C. | 539 mm | 7.7 seconds |
| Rinsing | 13 liter | 17° C. flowing water | 263 mm | 3.8 seconds |
| Squeeze | | | 304 mm | 4.4 seconds |
| Drying | | hot air 40° C. | 368 mm | 5.3 seconds |
| | | (heat roller 100° C. 2 pairs) | | |
| Total | | | 2087 mm | 30.0 seconds |

The processing solutions are as follows:

| Development processing | |
|---|---|
| Preparation of the condensed solutions: | |
| (1) Developing solution: | |
| Part agent A | |
| Potassium hydroxide | 270 g |
| Potassium sulfite | 1125 g |
| Sodium carbonate | 450 g |
| Boric acid | 75 g |
| Diethylene glycol | 150 g |
| Diethylenetriaminepentacetic acid | 30 g |
| 1-(N,N-diethylamino)ethyl-5-mercapto-tetrazole | 1.5 g |
| Hydroquinone | 405 g |
| 4-Hydroxymethyl-4-methyl-1-phenyl-3-pyrazolidone | 30 g |
| Water was added to | 4500 ml |
| Part agent B | |
| Tetraethylene glycol | 750 g |
| 3-3'-Dithiobishydrocinnamic acid | 3 9 |
| Glacial acetic acid | 75 g |
| 5-Nitroindazole | 4.5 g |
| 1-Phenyl-3-pyrazolidone | 67.5 g |
| Water was added to | 1000 ml |
| Part agent C | |
| Glutaraldehyde (50 wt/wt %) | 150 g |
| Potassium bromide | 15 g |
| Potassium metabisulfite | 120 g |
| Water was added to | 750 ml |
| (2) Fixing solution: | |
| Anunonium thiosulfate (70 wt/vol %) | 3000 ml |
| Disodium ethylenediaminetetracetate dihydrate | 0.45 g |
| Sodium sulfite | 225 g |
| Boric acid | 60 g |
| 1-(N,N-dimethylamino)-ethyl-5-mercapto-tetrazole | 15 g |
| Tartaric acid | 48 g |

-continued

| Development processing | |
|---|---|
| Glacial acetic acid | 675 g |
| Sodium hydroxide | 225 g |
| Sulfuric acid (36N) | 58.5 g |
| Aluminum sulfate | 150 g |
| Water was added to | 6000 ml |
| pH | 4.68 |

Preparation of the processing solutions

The above developing solution was placed in a vessel in the below amounts of each part. The vessel is constituted by combining the respective part vessels of the part agents A, B and C with the vessels themselves so as to make one vessel.

The above fixing solution was placed in a similar vessel.

First, 300 ml of an aqueous solution containing 54 g of acetic acid and 55.5 g of potassium bromide was put in a developing bath as a starter.

The vessels containing the above processing solutions were inserted in an inverted position into drilling blades in the processing solution stock tanks disposed at the side of an automatic processor to break the sealing membranes provided on the caps, and the respective processing solutions in the vessels were placed in the stock tanks.

The respective processing solutions were placed in a developing bath and a fixing bath of the automatic processor in the following ratio by the pumps of the automatic processor.

The replenishing rate was 10 ml/sheet (10 inch×12 inch) in both of the developing solution and the fixing solution.

| | |
|---|---|
| Developing solution: | |
| Part agent A | 60 ml |
| Part agent B | 13.4 ml |
| Part agent C | 10 ml |
| Water | 116.6 ml |
| pH | 10.50 |
| Fixing solution: | |
| Condensate | 80 ml |
| Water | 120 ml |
| pH | 4.62 |

City water was filled in a rinsing bath.

Samples in accordance with the present invention had excellent photographic performances.

EXAMPLE 5

Light-sensitive materials were prepared in the same manner as in Examples 1 and 2, except that glutaraldehyde was removed from part agent C of the developing solution and the processing was carried out with the replenishing amounts of the developing solution and the fixing solution set at 11 ml/sheet (10 inch x 12 inch) and at a processing time of 30 seconds. Similar excellent photographic performances were obtained.

EXAMPLE 6

The procedure in Example 4 was repeated, except that the developing solution and the fixing solution were replaced with the following developing solution and fixing solution, processing was carried out with replenishing amounts thereof set at 20 ml/sheet (10 inch×12 inch), and the processing time was 45 seconds. Similar excellent photographic performances were obtained.

| Developing solution: | |
|---|---|
| Part agent A | |
| Potassium hydroxide | 28.0 g |
| Potassium sulfite | 75.0 g |
| Diethylenetriaminepeantacetic acid | 2.0 g |
| Sodium carbonate | 30.0 g |
| Hydroquinone | 18.0 g |
| 1-(diethylamino)-ethyl-5-mercapto-tetrazole | 0.1 g |
| Potassium bromide | 1.0 g |
| Water was added to | 300 ml |
| Part agent B | |
| Triethylene glycol | 6.0 g |
| 5-Nitroindazole | 0.3 g |
| Acetic acid | 40.0 g |
| 1-Phenyl-3-pyrazolidone | 3.5 g |
| 3-3'-Dithiobishydrocinnamic acid | 0.2 g |
| Water was added to | 50 ml |
| Water was added to make a 1 liter solution (pH was adjusted to 10.30). | |
| The replenshing ratio was: | |
| Part agent A | 300 ml |
| Part agent B | 50 ml |
| Water | 650 ml |
| COD (chemical oxygen demand) of the above solution was about 50,000. | |
| Fixing solution: | |
| Part agent A | |
| Sodium thiosulfate | 96.4 g |
| Disodium ethylenediaminetetracetate dihydrate | 0.025 g |
| Sodium metabisulfite | 22.0 g |
| Water was added to | 500 ml |
| pH was adjusted with NaOH | 5.0 |
| The replenishing ratio was | |
| Part agent A | 500 ml |
| Water | 500 ml |
| COD of the above solution was about 40,000. | |

EXAMPLE 7

Example 1 of the present invention was repeated, except that the method for preparing the emulsion was changed to prepare those of various sizes and provide plural emulsion layers, whereby there were obtained the same gradations as those of SHRS, SHRL, SHRA, SHRC, SHRG, and HRHA (all manufactured by Fuji Photo Film Co., Ltd.).

The embodiment in Example 1 of the present invention was repeated, except that the method for preparing the emulsion was changed to prepare those of various sizes and provide plural emulsion layers, whereby there were obtained the same gradations as those of MINP, MIMA, and MINP (all manufactured by Fuji Photo Film Co., Ltd.).

EXAMPLE 8

The same procedure as that in Example 1 was repeated, except that the matting agent was changed as shown in Table 5.

TABLE 5

| Matting agent No. | Average grain size (μm) | Settling amount of matting agent* A | B | Matting agent component** |
|---|---|---|---|---|
| 1-1 (Comp.) | 4.0 | | 40% | MMA 100 |
| 1-2 (Comp.) | 4.1 | | 60% | MMA/MA = 80/20 |
| 1-3 (Comp.) | 3.8 | | 50% | MMA/St = 50/50 |
| 1-4 (Inv.) | 3.8 | 20% | 15% | MMA/MAA = 80/20 |
| 1-5 (Comp.) | 4.1 | | 55% | MMA/St = 48/47<br>cross linking agent: ethylene glycol dimethacrylate : 5 |
| 1-6 (Inv.) | 4.0 | 30% | 30% | MMA/MA/MAA = 70/15/15 |
| 1-7 (Inv.) | 3.9 | 20% | 15% | MMA/St/MAA + 36/36/20<br>ethylene glycol dimethacrylate : 8 |
| 1-8 (Inv.) | 3.8 | 15% | 10% | MMA/MAA = 75/20<br>ethylene glycol dimethacrylate : 5 |
| 1-9 (Inv.) | 4.0 | 10% | 10% | MMA/MA/MAA = 60/15/15<br>ethylene glycol dimethacrylate : 10 |

*)A: matting agent test amount by the test method described in claim 1.
B: settling amount of the matting agent in the surface protrective layer coating solution after leaving for standing at 40° C. for 24 hours.
**)All the matting agent components had molecular weight of about 60,000.

The coated light-sensitive materials thus prepared were cut into 600 sheets each having a size of 18 cm×38 cm, and each was subjected to a running processing with the automatic processor Model CEPROS-M and an automatic feeder without replenishing the fixing solution. After processing 600 sheets, 1 liter of the developing solution was sampled and filtered with a FM-22, 47-00 filter. The weight of the filtrated matters was measured to obtain the results shown in Table 6. The filtrated residue was observed with a microscope and analyzed with an infrared spectroscopy to confirm that it was matting agent.

The number of inferior transportations caused when the light-sensitive materials were subjected to a running test at 25° C. and 25% RH are summarized in Table 6, wherein matting agent numbers correspond to those in Table 5. It will be appreciated from the above results that the light-sensitive materials according to the present invention have less occurrence of peeling off and eluting of the matting agent and have excellent transporting performance.

TABLE 6

| Light-sensitive matrerial | Kind of matting agent | Matting agent amount in the developing solution | Frequency of bad transportation |
|---|---|---|---|
| 1 | 1-1 | 0.15 g/liter | 10 |
| 2 | 1-2 | 0.18 g/liter | 6 |
| 3 | 1-3 | 0.15 g/liter | 8 |
| 4 | 1-4 | 0.04 g/liter | 6 |
| 5 | 1-5 | 0.12 g/liter | 6 |
| 6 | 1-6 | 0.045 g/liter | 7 |
| 7 | 1-7 | 0.01 g/liter | 0 |
| 8 | 1-8 | 0.01 g/liter | 0 |
| 9 | 1-9 | 0.01 g/liter | 1 |

EXAMPLE 9

The light-sensitive materials 9-1 to 9-9 corresponding to the light-sensitive materials 1 to 9 prepared in Example 8 were prepared in the same manners as those in Example 8, except that the coated amount of gelatin contained in the surface protective layer coating solution was changed to 0.65 g/m$^2$. Surface protective layer coating solution settling tests and tests of matting agent peel off and an inferior transportation were conducted in the same manners as those in Example 1, whereby the results shown in Table 7 were obtained, where matting agent numbers correspond to those of Table 5. It will be appreciated that the light-sensitive materials of the present invention had excellent photographic performances, particularly which reduced coated amounts of gelatin.

TABLE 7

| Light-sensitive matrerial | Kind of matting agent | Settling amount* of matting agent | Matting agent amount in the devoloping solution | Frequency of bad transportation |
|---|---|---|---|---|
| 9-1 (Comp.) | 1-1 | 60% | 0.22 g/liter | 12 |
| 9-2 (Comp.) | 1-2 | 70% | 0.21 g/liter | 10 |
| 9-3 (Comp.) | 1-3 | 70% | 0.20 g/liter | 10 |
| 9-4 (Inv.) | 1-4 | 30% | 0.08 g/liter | 7 |
| 9-5 (Comp.) | 1-5 | 80% | 0.15 g/liter | 7 |
| 9-6 (Inv.) | 1-6 | 40% | 0.056 g/liter | 8 |
| 9-7 (Inv.) | 1-7 | 20% | 0.015 g/liter | 1 |
| 9-8 (Inv.) | 1-8 | 15% | 0.010 g/liter | 1 |
| 9-9 (Inv.) | 1-9 | 15% | 0.015 g/liter | 0 |

*settling amount of the matting agent in the surface protrective layer coating solution after leaving for standing at 40° C. for 24 hours.

EXAMPLE 10

The coating solutions and the light-sensitive materials 10-1 to 10-9 corresponding to the light-sensitive materials 1 to 9 prepared in Example 8 were prepared in the same manners as those in Example 1, except that the coated amount of the following compound:
contained in the surface protective layer coating solution was reduced to 15 mg/m$^2$.

These coating solutions were evaluated by the same settling method as that in Example 8 resulting in the matting agent being precipitated by only up to 10%. Meanwhile, the light-sensitive materials were subjected to processing with the automatic processor described in Example 8 at 25° C. and 10% RH to find that any of the light-sensitive materials had the generation of a static mark and was fogged. Accordingly, it was confirmed that the decreasing the amount of polkyethylene oxide resulted in light-sensitive materials having inferior handling performance, while settling of walling agent in the coating solution was prevented.

EXAMPLE 11

The light-sensitive materials of the present invention prepared by the manufacturing method according to the present invention described in Examples 8 and 9 were subjected to evaluation of the following photographic performances.

Evaluation of the photographic performances

The X ray ortho-screen HR-4 manufactured by Fuji Photo Film Co., Ltd. was used to expose the light-sensitive material for 0.05 second on both sides and evaluation was carried out. The others were the same as those in Example 4 and processing was carried out in the same manner as that in Example 4.

The results showed that the samples of the present invention had excellent photographic performances.

EXAMPLE 12

The light-sensitive materials were prepared in the same manners as those in Examples 8 and 9, except that glutaraldehyde was removed from part agent C of the developing solution and processing was carried out with the replenishing amounts of the developing solution and the fixing solution set at 11 ml/sheet (10 inch×12 inch), and at a processing time of 30 seconds. Similar results were obtained.

EXAMPLE 13

The procedure in Example 11 was repeated, except that processing was carried out in the developing solution and fixing solution used in Example 6 with the replenishing amounts thereof set at 20 ml/sheet (10 inch×12 inch), and at processing time of 45 seconds. Similar results were obtained.

EXAMPLE 14

Example 8 of the present invention was repeated, except that the method for preparing the emulsion was changed to prepare emulsions of various sizes and provide plural emulsion layers, whereby there were obtained the same gradations as those of SHRS, SHRL, SHRA, SHRC, SHRG, and HRHA (all manufactured by Fuji Photo Film Co., Ltd.).

The embodiment in Example 8 of the present invention was repeated, except that the method for preparing the emulsion was changed to prepare emulsions of various sizes and provide plural emulsion layers, whereby there were obtained the same gradations as those of MINP, MIMA, and MINP (all manufactured by Fuji Photo Film Co., Ltd.).

While the invention has been described in detailed with reference to specific embodiments, it will be apparent to one skilled in the art that various changes and modifications can be made to the invention without departing from its spirit and scope.

What is claimed is:

1. A silver halide photographic material, comprising a support having provided thereon at least one light-sensitive emulsion layer and at least one surface protective layer containing a hydrophilic colloid, gelatin present in a coated amount of up to 0.8 g/m$^2$ and a polymer latex having an average particle size of at least 2 μm, wherein an amount of a precipitate generated after placing the polymer latex in a test coating solution and leaving the test coating solution and the polymer latex standing at 40° C. for 16 hours is up to 30 weight % of the polymer latex added to the test coating solution, the testing coating solution comprising:

| Ingredient | Amount |
|---|---|
| Gelatin (having a Ca content of at least 2000 ppm so as to provide the test coating solution with a viscosity of 0.2 to 0.3 poise at 40° C.) | 500 g |

-continued

| Ingredient | Amount |
|---|---|
| Polymer latex (as a solid matter dispersed in a 5 weight % gelatin solution so that the solid matter becomes 10 weight %) | 47 g |
| $H_2O$ | 400 ml |
| 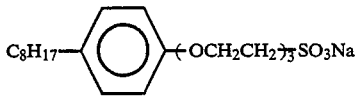 | 0.09 g |
| $C_{16}H_{33}O(CH_2CH_2O)_{10}H$ | 0.51 g |
| Poly (sodium acrylate) (average molecular weight: 400,000) | 1.0 g |

wherein the dispersion of the polymer latex is added to a solution prepared by swelling and dissolving the gelatin in water at 40° C. and then the other compounds are added and mixed while stirring.

2. The silver halide photographic material of claim 1, further comprising a water soluble polymer, the water soluble polymer being present in an amount of at least 10% based on the whole gelatin coated amount on the side of the support having the at least one surface protective layer.

3. The silver halide photographic material of claim 1, further comprising at least one compound represented by the following Formulas (I-1), (I-2) and (I-3) provided in the at least one surface protective layer, the compound being present in an amount of at least 20 mg/m$^2$:

$$R_1-A(CH_2CH_2O)_{n1}H \quad \text{I-1}$$

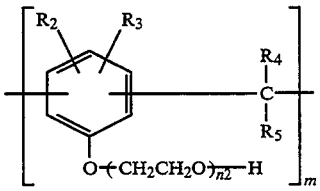

I-2

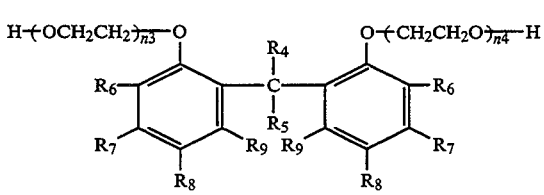

I-3 wherein:

$R_1$ represents a substituted or unsubstituted alkyl group having 1 to 30 carbon atoms, a substituted or unsubstituted alkenyl group having 1 to 30 carbon atoms, or a substituted or unsubstituted aryl group having 6 to 30 carbon atoms; A represents a —O— group, a —S— group, a —COO— group, a —N($R_{10}$)— group, a —CO—N($R_{10}$)— group, or a —$SO_2$—N($R_{10}$)— group, where $R_{10}$ represents a hydrogen atom or a substituted or unsubstituted alkyl group;

$R_2$, $R_3$, $R_7$ and $R_9$ each represents a hydrogen atom, a substituted or unsubstituted alkyl group, a substituted or unsubstituted aryl group, a substituted or unsubstituted alkoxy group, a substituted or unsubstituted acyl group, a halogen atom, an amide group, a sulfonamide group, a carbamoyl group, or a sufamoyl group;

$R_6$ and $R_8$ each represents a substituted or unsubstituted alkyl group, a substituted or unsubstituted aryl group, a substituted or unsubstituted alkoxy group, a substituted or unsubstituted acyl group, a halogen atom, an amide group, a sulfonamide group, a carbamoyl group, or a sufamoyl group;

$R_6$, $R_7$, $R_8$ and $R_9$ may be laterally asymmetric; $R_4$ and $R_5$ each represents a hydrogen atom, a substituted or unsubstituted alkyl group, or a substituted or unsubstituted aryl group;

$R_4$ and $R_5$, $R_6$ and $R_7$, and $R_8$ and $R_9$ may be combined with each other to form a ring;

$n_1$, $n_2$, $n_3$ and $n_4$ each are 2 to 50; and m is 2 to 50.

4. The silver halide photographic material of claim 1, wherein the polymer latex is a latex of a polymer having a hydrophilic group.

5. The silver halide photographic material of claim 4, wherein the hydrophilic group is selected from the group consisting of a carboxyl group, a phosphonic acid group, a sulfonic acid group, and a sulfuric acid group.

6. The silver halide photographic material of claim 4, wherein polymer is a copolymer of methylmethacrylate and methacrylic acid having a ratio of methylmethacrylate to methacrylic acid of 70/30 to 95/5; or a copolymer of methylmethacrylate/methylacrylate/methacrylic acid having a ratio of methylacrylate/methacrylic acid of 60/40 to 95/5 and methylacrylate is present in an amount of 0 to 50% based on the amount of methylmethacrylate.

7. The silver halide photographic material of claim 1, wherein the surface layer contains a coated amount of the polymer latex in the range of 0.001 to 0.3 g/m$^2$.

8. The silver halide photographic material of claim 7, wherein the surface layer contains a coated amount of the polymer latex in the range of 0.01 to 0.15 g/m$^2$.

9. A silver halide photographic material, comprising a support having provided thereon at least one light-sensitive emulsion layer and at least one surface protective layer containing a hydrophilic colloid, gelatin present in a coated amount of up to 0.8 g/m$^2$ and a cross-linked polymer latex having a hydrophilic group.

10. The silver halide photographic material of claim 9, further comprising a water soluble polymer, the water soluble polymer being present in an amount of at least 10% based on the whole gelatin coated amount on the side of the support having the at least one protective layer.

11. The silver halide photographic material of claim 9, further comprising at least one compound represented by the following Formulas (I-1), (I-2) and (I-3) provided in the at least one surface protective layer containing the polymer latex, the compound being present in an amount of at least 20 mg/m$^2$:

$$R_1-A-(CH_2CH_2O)_{n1}-H \quad \text{I-1}$$

I-2

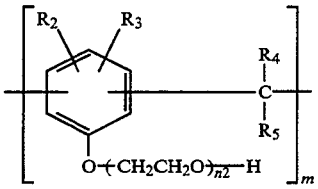

-continued

I-3

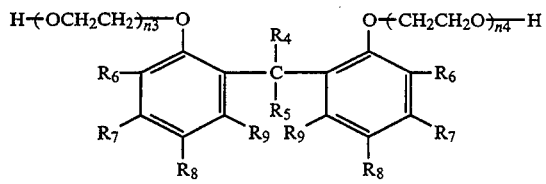

wherein:

$R_1$ represents a substituted or unsubstituted alkyl group having 1 to 30 carbon atoms, a substituted or unsubstituted alkenyl group having 1 to 30 carbon atoms, or a substituted or unsubstituted aryl group having 6 to 30 carbon atoms; A represents a —O— group, a —S— group, a —COO— group, a —N($R_{10}$)— group, a —CO—N($R_{10}$)— group, or a —$SO_2$—N($R_{10}$)— group, where $R_{10}$ represents a hydrogen atom or a substituted or unsubstituted alkyl group;

$R_2$, $R_3$, $R_7$ and $R_9$ each represents a hydrogen atom, a substituted or unsubstituted alkyl group, a substituted or unsubstituted aryl group, a substituted or unsubstituted alkoxy group, a substituted or unsubstituted acyl group, a halogen atom, an amide group, a sulfonamide group, a carbamoyl group, or a sufamoyl group;

$R_6$ and $R_8$ each represents a substituted or unsubstituted alkyl group, a substituted or unsubstituted aryl group, a substituted or unsubstituted alkoxy group, a substituted or unsubstituted acyl group, a halogen atom, an amide group, a sulfonamide group, a carbamoyl group, or a sufamoyl group;

$R_6$, $R_7$, $R_8$ and $R_9$ may be laterally asymmetric; $R_4$ and $R_5$ each represents a hydrogen atom, a substituted or unsubstituted alkyl group, or a substituted or unsubstituted aryl group;

$R_4$ and $R_5$, $R_6$ and $R_7$, and $R_8$ and $R_9$ may be combined with each other to form a ring;

$n_1$, $n_2$, $n_3$ and $n_4$ each are 2 to 50; and m is 2 to 50.

12. The silver halide photographic material of claim 9, wherein the cross-linked polymer latex is a cross-linked polymer latex of a copolymer including a repeating unit represented by the formula:

$$(A)_x(B)_y(C)_z \quad \text{II}$$

wherein A represents a monomer having a hydrophilic group, B represents a cross-linkable monomer, C represents a vinyl monomer other than B and C, and x, y and z represent a copolymerization ratio in which x is 0.1 to 30 mol%, y is 0.1 to 30 mol % and z is 0 to 95 mol %.

13. The silver halide photographic material of claim 12, wherein the copolymer is a copolymer of: methylmethacrylate, styrene and methacrylic acid in a mol % ratio of 36/36/20/8, respectively; methylmethacrylate, methacrylic acid and ethylene glycol dimethacrylate in a mol % ratio of 75/20/5, respectively; methylmethacrylate, methylacrylate, methylacrylic acid and ethylene glycol dimethylacrylate in a mol % ratio of 60/15/15/10, respectively; methylmethacrylate, methacrylic acid and divinylbenzene in a mol % ratio of 75/20/5, respectively; methylmethacrylate, methacrylic acid and ethylene glycol dimethacrylate in a mol % ratio of 70/25/5, respectively; methylmethacrylate, methacrylic acid and ethylene glycol dimethacrylate in a mol % ratio of 70/20/10, respectively; ethylmethacrylate, acrylic acid and divinylbenzene in a mol % ratio of 80/15/5, respectively; ethylmethacrylate, ethylacrylate, acrylic acid and ethylene glycol dimethacrylate in a mol % ratio of 35/35/20/10, respectively; or methylmethacrylate, methacrylic acid and ethylene glycol dimethacrylate in a mol % ratio of 75/20/5, respectively.

14. The silver halide photographic material of claim 9, wherein the surface layer contains a coated amount of the polymer latex in the range of 0.001 to 0.3 $g/m^2$.

15. The silver halide photographic material of claim 14, wherein the surface layer contains a coated amount of the polymer latex in the range of 0.01 to 0.15 $g/m^2$.

16. The silver halide photographic material of claim 9, wherein the cross-linked polymer latex has an average particle size of 2 to 15 $\mu m$.

* * * * *